US006164977A

United States Patent [19]

Lester

[11] Patent Number: 6,164,977

[45] Date of Patent: Dec. 26, 2000

[54] STANDOFF BOARD-MOUNTED COAXIAL CONNECTOR

[75] Inventor: Lester Joaquin Lester, Signal Hill, Calif.

[73] Assignee: ITT Manufacturing Enterprises, Inc., Wilmington, Del.

[21] Appl. No.: 09/020,366

[22] Filed: Feb. 9, 1998

[51] Int. Cl.[7] ..... H01R 12/00

[52] U.S. Cl. ..... 439/63; 439/581

[58] Field of Search ..... 439/581, 63, 578, 439/579, 582–585

[56] References Cited

U.S. PATENT DOCUMENTS

| | | | |
|---|---|---|---|
| 4,412,717 | 11/1983 | Monroe | 439/581 |
| 4,453,796 | 6/1984 | Monroe | 439/581 |
| 4,603,926 | 8/1986 | Nesbit et al. | 439/63 |
| 4,645,288 | 2/1987 | Stursa | 439/63 |
| 4,964,805 | 10/1990 | Gabany | 439/63 |
| 5,088,937 | 2/1992 | Gabany | 439/481 |
| 5,120,258 | 6/1992 | Carlton | 439/581 |
| 5,215,470 | 6/1993 | Henry et al. | 439/63 |
| 5,411,409 | 5/1995 | Gray et al. | 439/329 |
| 5,478,258 | 12/1995 | Wang | 439/581 |
| 5,645,454 | 7/1997 | Kosmala | 439/675 |

*Primary Examiner*—Paula Bradley
*Assistant Examiner*—Briggitte Hammond
*Attorney, Agent, or Firm*—Thomas L. Peterson

[57] ABSTRACT

A coaxial connector has a board mount end (14) for mounting on a circuit board, with a standoff (70) thereat to lie above circuit board traces and allow the passage of wash fluid that washes away soldering flux etc., which minimizes a change in impedance along the standoff to reduce signal losses. The standoff, which is connected to the outer contact (24) of the connector, has a circular inner surface (90) that faces the pin part (34) of the center contact, and which has segments (81–84) which, together, extend at least about 180° about the pin. The outer contact which surrounds a mount-end insulator (62) and the inner contact, has a slot (120) at the mount end to enable the installation of the center contact.

6 Claims, 3 Drawing Sheets

FIG. 7
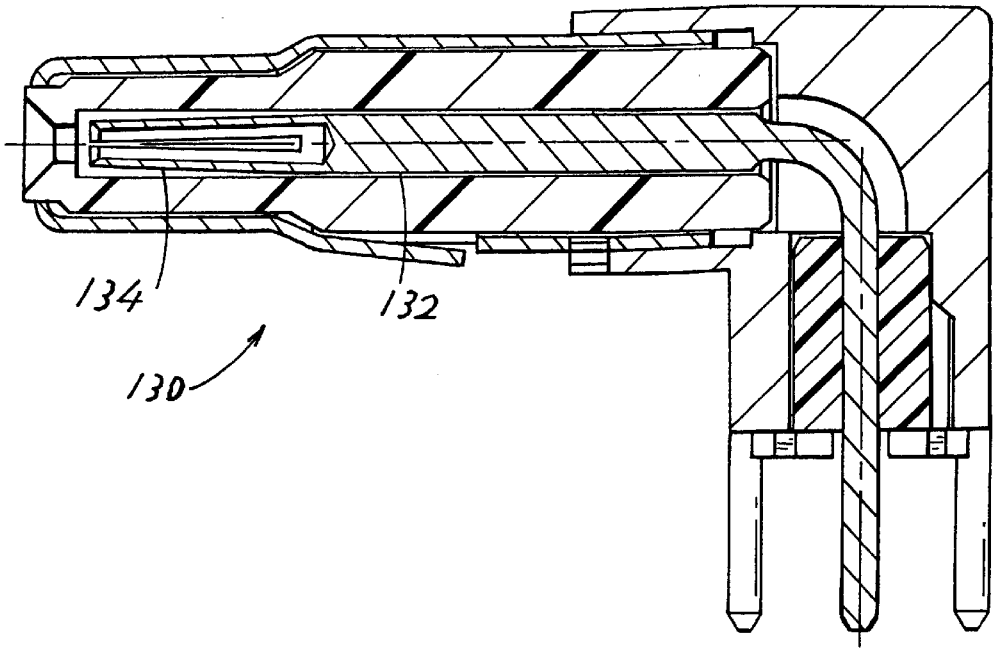
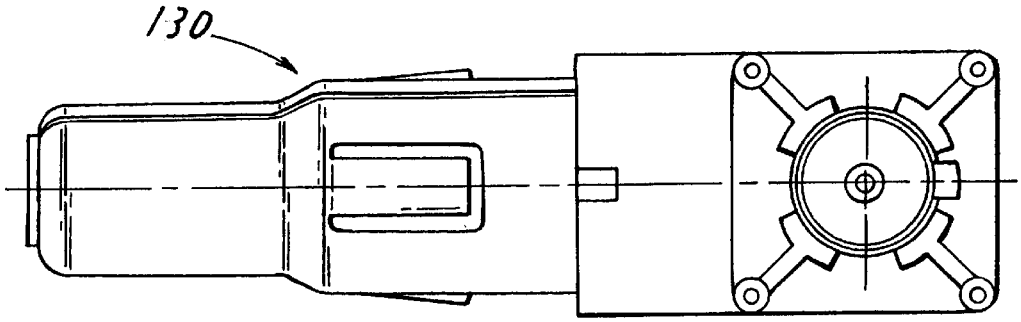
FIG. 8

STANDOFF BOARD-MOUNTED COAXIAL CONNECTOR

BACKGROUND OF THE INVENTION

One type of coaxial connector has a board mount end which is mounted on a circuit board, with both the inner and outer coaxial contacts soldered thereat to conductive traces on an upper surface of the board. The inner conductor commonly includes a pin part that extends into a plated hole in the circuit board, while the outer conductor includes a plurality of posts, such as four of them, that extend into plated holes in the circuit board. The outer conductor includes a standoff with a passage leading to the pin part, to keep the outer conductor from touching a trace on the circuit board that extends to the pin-receiving hole, and to pass cleaning fluid that washes away solder flux and the like, especially at the solder joint where the pin part is soldered to a trace. There is a sudden change in impedance along the short height of the standoff, as from a desired characteristic impedance of perhaps 50 ohms to perhaps 130 ohms. This large change in impedance results in reflections at very high frequencies, resulting in losses and distortion. It would be desirable if the characteristic impedance increased a minimum amount along the standoff.

The coaxial connector commonly has a mating end, opposite the board-mount end, which extends perpendicular to the board-mount end. Two separate insulators are installed in the two perpendicular ends. However, a single inner conductor must be installed, which is difficult to do because of the 90° bend. Many prior coaxial connectors of this type form the outer conductor with a window that aids in installing the bent inner conductor, with a bendable door to close the window. However, such a door is commonly formed in a die cast part of the outer conductor, and it is not uncommon for the door to break off after having been bent back into place. A construction of the outer conductor or enclosure of a coaxial connector which facilitated installation of a 90° bend center conductor, would be of value.

SUMMARY OF THE INVENTION

In accordance with one embodiment of the present invention, a coaxial connector is provided which reduces the characteristic impedance at a standoff lying at the board-mount end of the connector, and which facilitates installation of the central contact of the connector within the outer contact. The standoff, which is part of the outer contact of the connector, has a bottom for lying on the circuit board, with the standoff having a primarily cylindrical inner surface that surrounds the pin part of the center contact and that is coaxial with it.

The outer contact has a mating end that extends perpendicular to the mount end, and the inner contact also requires a substantially 90° bend. To facilitate insertion of the inner contact, the mount end of the outer contact is provided with a vertical slot on a side thereof opposite the mating end.

The novel features of the invention are set forth with particularity in the appended claims. The invention will be best understood from the following description when read in conjunction with the accompanying drawings.

BRIEF DESCRIPTION OF THE DRAWINGS

FIG. 7 is a sectional view of a coaxial connection similar to that of FIG. 1, but of a plug type.

FIG. 8 is a bottom view of the connector of FIG. 7.

DESCRIPTION OF THE PREFERRED EMBODIMENTS

Figure 1:
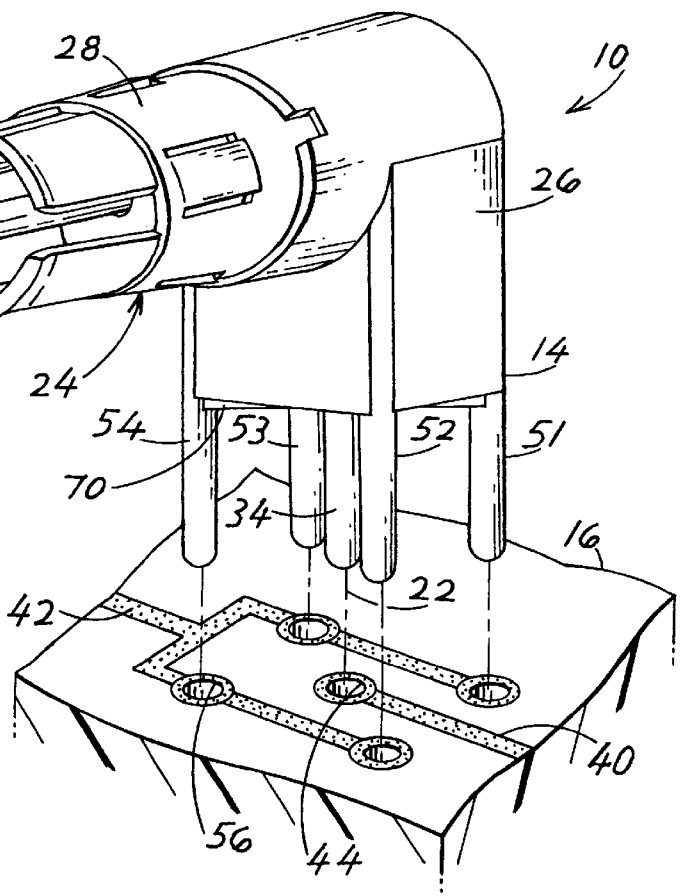
FIG. 1 is an exploded isometric view of a coaxial connector of the receptacle type and a portion of a circuit board on which the connector is mounted.

FIG. 1 illustrates a coaxial connector 10 with a mating end or end portion 12 for mating to another connector such as one that has been terminated to an end of a coaxial cable, and an opposite board mount end or end portion 14 for mounting on a circuit board 16. The coaxial connector has its mating and board mount ends extending along perpendicular axes 20, 22. The connector includes an outer contact or enclosure 24 formed by a die cast part 26 and a bent sheet metal part 28. The inner conductor 30 is formed of a single piece of metal with a mating end 32 and with a board mount end or pin part 34. The circuit board 16 has a plurality of conductive traces including a signal trace 40 and a ground trace 42, each trace leading to at least one plated circuit board hole. The pin part is designed to fit into a first plated through hole 44 and to be soldered to the signal trace 40. The outer contact or conductor 24 includes four mount posts 51–54 that can project into corresponding plated-through holes 56 in the circuit board that extend to the ground trace 42, with each pin or post being soldered to the area of the trace immediately around each hole.

Figure 2:
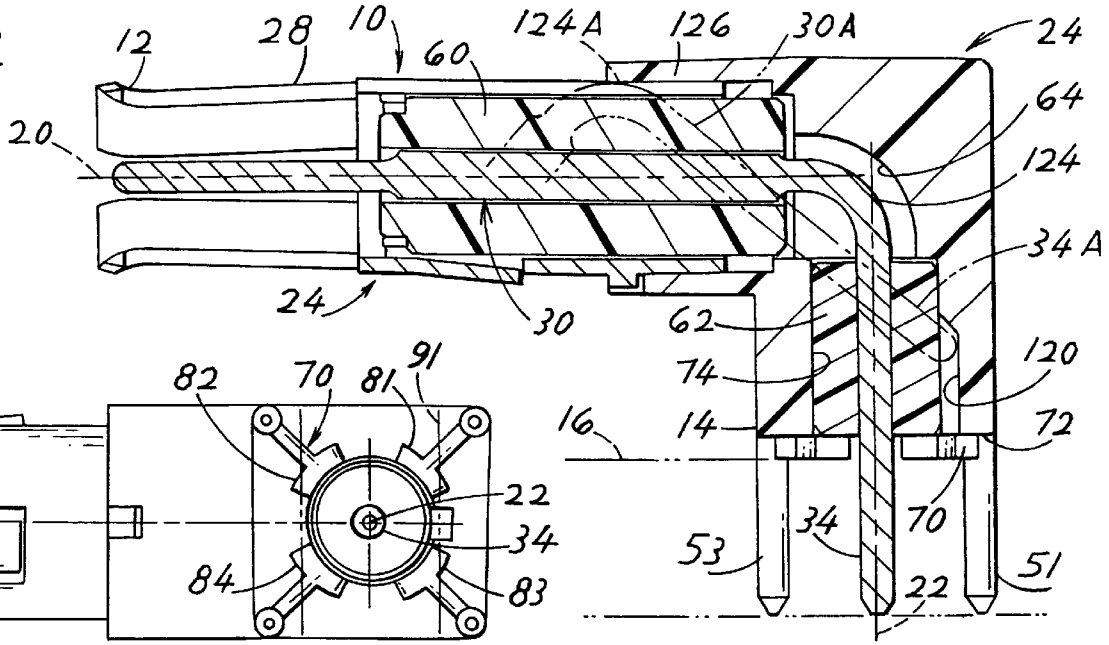
FIG. 2 is a sectional view of the connector of FIG. 1, with the circuit board shown in phantom lines.

FIG. 2 shows additional details of the construction of the coaxial connector 10. The connector includes a mate end insulator 60 and a mount end insulator 62. The diameters of the insulators 60, 62, and the smaller inside diameter at 64 in the outer contact at the 90° bend, are chosen to maintain a characteristic impedance of close to 50 ohms along the entire connector. Where there are large changes in characteristic impedance, high frequency signals are reflected and the VSWR (voltage standing wave ratio) is increased, resulting in loss of signal power and signal distortions.

The board-mount end 14 of the metal enclosure or outer conductor 24 includes a short column or standoff 70 that spaces a flat lower end 72 of the enclosure from the circuit board 16. The standoff provides one or more horizontal (parallel to the planes of the circuit board) passages through itself leading to the pin part 34 of the inner contact 30. The passages prevent direct contact between the outer conductor 24 and the signal trace or traces 40 (FIG. 1) on the circuit board. The passages also permit the ready flow of washing fluid that is used to wash away solder flux used in soldering the pin part 34 to the signal circuit board trace, since solder flux can be corrosive.

The insulators 60, 62 are of sold material which has a dielectric constant much higher than that of air. For example, Teflon can be used which has a dielectric constant of about 2.5. To maintain a 50 ohm characteristic impedance along the length of the connector, the inner surface 74 of the outer contact is made larger to account for the higher dielectric constant of the insulator 62, except at the bend 64. Since air has a dielectric constant of 1.0, maintenance of a characteristic impedance not too much greater than 50 ohms along the short length of the standoff 70 would require that the standoff lie closely around the pin part 34. This cannot be easily accomplished because a large space is required for installing the mount-end insulator 62. However, it is desirable to maintain a relatively low characteristic impedance thereat.

Figure 5:
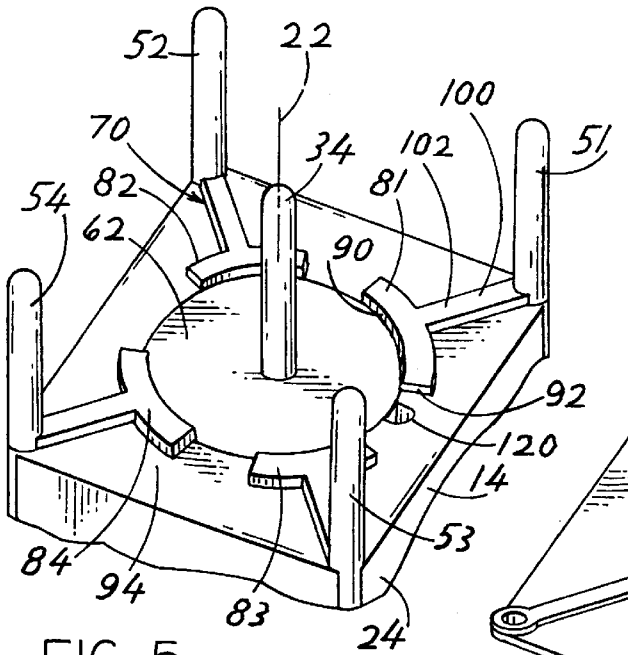
FIG. 5 is an upside-down isometric view of just the board mount end of the connector of FIG. 1.

As shown in FIG. 5, applicant constructs the column or standoff 70 to minimize the characteristic impedance along the vertical height of the standoff, while providing horizontal passages for circuit board traces and for the rapid and effective flow through of wash out fluid. The standoff is formed in a plurality of segments 81–84. Each segment has an inner surface 90 which is circular as viewed along the second axis 22. The circular inner surfaces 90 provide a uniform impedance around the pin part 34 of the inner conductor, with the characteristic impedance being as low as possible, considering the need to install the mount end insulator 62. Gaps or passages 92 between the segments 81–84 enable the signal circuit board trace 40 (FIG. 1) to lie under the connector without touching the outer conductor 24.

The provision of four gaps between the four segments, enables the connector with four mounting posts 51–54 to be mounted at any of four possible orientations on the circuit board without altering the positions of the signal circuit board trace. The four gaps 92 also enable the rapid pass through of wash out fluid that is used to wash away soldering flux and other debris that could corrode or damage the solder joints. Often, such fluid is directed to flow in one direction across the circuit board, and the four gaps permit the rapid flow through of wash out fluid regardless of the direction in which fluid flows past the standoff 70. Applicant prefers to provide cutaways 94 on the radially outer side of each segment 81–84 leave gaps 92 of relatively short length. Each of the segments 81–84 with a circular inner surface 90 is connected to a corresponding mounting post 51–54 through a coupling portion 100 of the standoff. The coupling portions and the segments 81–84 preferably have flush flat lower faces 102, to enable the direct flow of current between the coupling segments 81–84 and the mounting posts 51–54 without requiring currents to zig or zag, which could result in reflections that deteriorate the signal. In soldering the outer contact to the grounded traces, the solder fillets preferably solder to the couplings 102 as well as to the posts 51–54. The four segments and the four gaps are preferably identical and uniformly spaced about the second axis 22.

Figure 3:
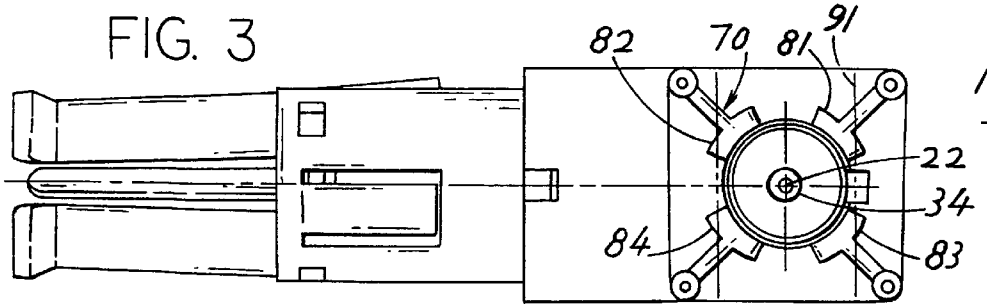
FIG. 3 is a bottom view of the connector of FIG. 2.
Figure 4:
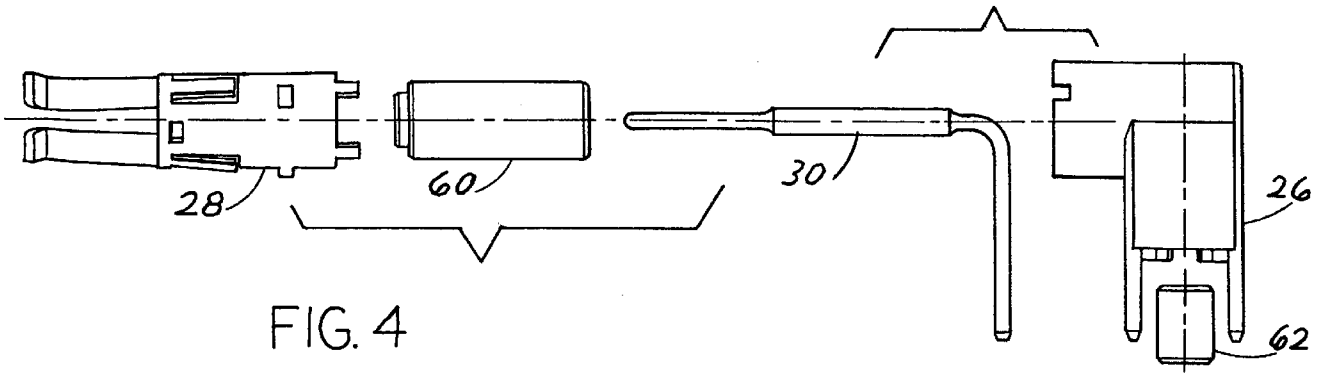
FIG. 4 is an exploded elevation view of the connector of FIG. 2.

FIG. 3 is a bottom view of the standoff 70, showing that the segment 81–84 occupy about 180° of the circle about the axis 22. Applicant prefers that the segments occupy a total of at least one-third of a circle, or at least 120°, about the second axis 22, where the segments have inner surfaces that all lie coaxial with the pin part 34 and its axis 22.

Figure 6:
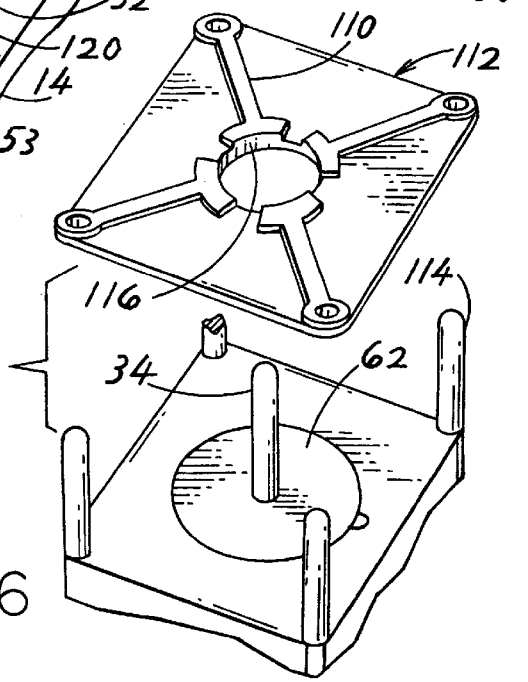
FIG. 6 is an isometric view of the board end of a coaxial connector constructed in accordance with another embodiment of the invention.

FIG. 6 shows another embodiment of the invention, where a standoff 110 is provided on a separate member 112 that is mounted on the posts 114 of the outer conductor. The separate member, which becomes part of the outer contact, allows installation of the insulator 62 and the subsequent mounting of the member 112 on the post. This allows inner surfaces 116 of segments to lie closer to the pin part 34 to achieve a lower characteristic impedance along the standoff. However, it should be understood that these types of coaxial connectors are sold at a low cost on the order of magnitude of one-dollar each, and the need for an additional member 112 that must be manufactured and mounted can add to the cost. The use of a separate member 112 would be useful for especially high frequencies such as those on the order of magnitude of 4 GHz and higher, where reflections from a change in impedance are more deleterious.

The assembly of the connector 10 of FIG. 2 involves first installing the inner contact 30 within the outer one 24. Because of the 90° bend at 124, this can be difficult to do. Applicant accomplishes this by providing a slot 120 in the mount end of the die cast part 26, the slot extending vertically (when the bottom 72 of the mount end is horizontal) and lying at a side of the second axis 22 opposite the mating end 12 of the connector. When the inner conductor 30 is to be installed, it is held to assume the orientation shown at 30A, wherein its approximately 90° bend at 124A lies against the inside of the die cast part 126 that extends along the first axis 20, while the pin part at 34A extends into the slot 120. After the inner conductor 30 is installed, the insulators 60, 62 and sheet metal part 28 are installed.

FIGS. 7 and 8 show a plug coaxial connector 130 which is substantially identical to the connector of FIGS. 1–6, except that the inner contact 132 has a socket mating end 134 instead of a pin mating end.

In a connector that applicant has designed, the connector had an overall horizontal length as shown in FIG. 2, of 0.88 inch (22 mm), the pin part 34 had a diameter of 0.03 inch (0.76 mm), and the standoff 70 had a height of about 0.02 inch (0.5 mm). Because of the very small size of the connector, and the corresponding very small height of the standoff, the provision of four passages for the traces and for the flow through of wash out fluid, are important. Applicant has measured that the characteristic impedance at the standoff was reduced from about 130 ohms in a prior art construction wherein the standoff included two parts with surfaces 91 as shown in FIG. 3, to 90 ohms, resulting in a significant reduction in VSWR. The coaxial connectors can be part of a larger connector device that may include noncoaxial contacts.

Thus, the invention provides a coaxial connector of the type that mounts on a circuit board, where a standoff that provides one or more passages between the board and the outer coaxial conductor is constructed to minimize a change in impedance thereat, and the connector is constructed to facilitate assembly. The standoff, which has a bottom for lying on the circuit board, extends at least partially around the center conductor pin part that projects into the circuit board, with the standoff having a surface of circular shape coaxial with the pin part as viewed along the second axis of the coaxial connector. The standoff preferably includes a plurality of segments that together surround more than 120% of the second axis along which the pin part extends, with each segment having a cutaway radially outside, and having a coupling extending between the segment and a corresponding mounting post, with the coupling and the segment having flat flush bottom surfaces. The outer conductor includes a die cast part at the mount, with a largely cylindrical inner surface for receiving an insulator, but with the inner surface having a groove or slot that aids in installing the inner contact.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector that has inner and outer contacts, where the connector has a board-mount end for mounting on a circuit board and connecting said contacts to circuit board traces, wherein:

at said board-mount end of said connector, said inner contact comprises a pin part extending along an axis and said outer contact has an electrically conductive standoff with a bottom for lying on said circuit board, with said standoff extending at least partially around said pin part, and with said standoff forming at least 120° of a primarily circular inner surface that faces said pin part and that is coaxial with said axis.

2. The coaxial connector described in claim 1 wherein:

said standoff has a plurality of segments that are circumferentially spaced apart about said axis.

3. A combination of a coaxial connector and a circuit board, where the connector has inner and outer contacts, a mount end mounted on the circuit board and an opposite mate end, and where the circuit board has a surface, a plurality of board holes, and a plurality of traces extending along said surface from said board holes, wherein:

said mount end of said inner contact forms a pin part that projects along an axis into one of said board holes and said mount end of said outer contact includes a plurality of posts lying around said pin part and projecting into a plurality of said holes;

said mount end of said outer contact also has a standoff with a lower end lying on said circuit board with said standoff having a plurality of passages with at least one lying above one of said traces, with parts of said standoff extending between said passages forming a surface that includes at least 120° of a circle concentric with said axis, as viewed along said axis.

4. A coaxial connector that has inner and outer contacts, where the connector has a board-mount end for mounting on a circuit board and connecting said contacts to circuit board traces, wherein:

at said board-mount end of said connector, said inner contact comprises a pin part extending along an axis and said outer contact has standoff means for providing a conductive surface facing said pin and coaxial with said pin along at least 180° about said axis with said standoff including at least one passage extending away from said pin part.

5. A coaxial connector that has inner and outer contacts, where the connector has a board-mount end for mounting on a circuit board that has holes and connecting said contacts to circuit board traces, wherein:

at said board-mount end of said connector, said inner contact comprises a pin part extending along an axis and said outer contact has a standoff with a bottom for lying on said circuit board, with said standoff extending at least partially around said pin part, and with said standoff forming at least 120° of primarily circular surface that faces said pin part and that is coaxial with said axis;

said outer conductor includes a plurality of mount posts extending parallel to said pin for insertion into said circuit board holes;

said standoff has coupling portions that extend from said inner surface of said standoff to each of said posts, with said coupling portions having lower surfaces that lie in a horizontal plane when the circuit board lies in a horizontal plane, to thereby minimize changes in directions of currents passing along a surface of said standoff from said inner surface of said standoff to said posts.

6. A coaxial connector that has inner and outer contacts, where the connector has a board-mount end for mounting on a circuit board that has holes and connecting said contacts to circuit board traces, wherein:

at said board-mount end of said connector, said inner contact comprises a pin part extending along an axis and said outer contact has a standoff with a bottom for lying on said circuit board, with said standoff extending at least partially around said pin part, and with said standoff forming at least 120° of primarily circular surface that faces said pin part and that is coaxial with said axis;

said outer conductor includes a plurality of mount posts extending parallel to said pin for insertion into said circuit board holes;

said standoff has coupling portions that extend horizontally from said inner surface to each of said posts, with said coupling portions having a plurality of cutaways forming passages extending from said standoff inner surface to the outside of said standoff, with each of said cutaways leaving a wide inner part extending circumferentially around said pin part and a narrower connecting part extending primarily radially between said inner portion and one of said posts.

* * * * *